United States Patent [19]

Carl et al.

[11] Patent Number: 4,545,781

[45] Date of Patent: Oct. 8, 1985

[54] METHOD FOR APPLYING COUPON PACKETS TO PAPER BAGS

[75] Inventors: Charles L. Carl, Portland; Ronald S. Gale, Beaverton; William J. Forstrom, West Linn, all of Oreg.

[73] Assignee: Willamette Industries, Inc., Beaverton, Oreg.

[21] Appl. No.: 575,501

[22] Filed: Jan. 30, 1984

[51] Int. Cl.[4] ..... B31B 1/90; B31B 37/74

[52] U.S. Cl. ..... 493/220; 493/216; 493/235; 493/931; 493/961

[58] Field of Search ..... 493/220, 216, 224, 235, 493/931, 961; 414/31; 383/39, 40

[56] References Cited

U.S. PATENT DOCUMENTS

| | | | |
|---|---|---|---|
| Re. 25,961 | 2/1966 | Volks et al. | 493/216 |
| D. 229,896 | 1/1974 | Bemel | D9/249 |
| D. 237,780 | 11/1975 | Bemel | D9/249 |
| 1,541,167 | 6/1925 | Mulvey | 206/618 |
| 1,621,049 | 3/1927 | Appel | 493/235 |
| 1,646,170 | 10/1927 | Shmyroff et al. | 414/31 |
| 2,083,860 | 6/1937 | Offenbacher | 206/541 |
| 2,226,943 | 12/1940 | Poppe | 229/70 |
| 2,614,349 | 10/1952 | Barnes | 40/2 R |
| 2,815,620 | 12/1957 | Prodigo | 53/415 |
| 2,917,164 | 12/1959 | Kehr | 206/232 |
| 2,958,437 | 11/1960 | Mengis | 493/220 |
| 3,155,234 | 11/1964 | Knott et al. | 206/17 |
| 3,168,016 | 2/1965 | Kehr | 493/216 |
| 3,183,614 | 5/1965 | Loderhose | 40/312 |
| 3,348,759 | 10/1967 | Johnson | 229/53 |
| 3,413,899 | 12/1968 | Timms | 493/220 |
| 3,611,883 | 10/1971 | Grob | 493/226 |
| 3,762,628 | 10/1973 | Sargent | 383/40 |
| 3,804,323 | 4/1974 | Bemel | 229/53 |
| 4,071,997 | 2/1978 | Gunther | 493/216 |
| 4,103,820 | 8/1978 | Mathison et al. | 229/37 R |
| 4,182,222 | 1/1980 | Stahl | 493/224 |
| 4,202,450 | 5/1980 | Howell et al. | 206/459 |

FOREIGN PATENT DOCUMENTS 1101199 3/1954 France .

*Primary Examiner*—Francis S. Husar
*Assistant Examiner*—William E. Terrell
*Attorney, Agent, or Firm*—Klarquist, Sparkman, Campbell, Leigh & Whinston

[57] ABSTRACT

A combination of a self-opening shopping bag and a coupon packet is disclosed together with apparatus and a method for making same. A flat coupon packet containing coupons is affixed to the front panel of the bag. The coupon packet is sized and positioned widthwise between the side gussets of the bag and spaced apart from the bottom of the bag so that, when the bag is folded flat, only the front and rear panels of the bag underlie the packet. The coupon-applying apparatus is designed and positioned to apply coupons at the beginning of the bag-making procedure. It includes a glue applicator mounted adjacent the former of the bag-making machine for applying a strip of glue to a side of the continuous sheet opposite the forming means, the strip extending lengthwise of the sheet in a predetermined lateral position. A packet feeder is mounted on the former just downstream of the glue applicator for feeding coupon packets lengthwise of the paper flat onto the continuous sheet upon the strip of glue. A mechanical and electrical timing system is operably connected to a rotationally driven element of the bag-making machine for synchronizing therewith the operation of the glue applicator and packet feeder. It is timed to position each packet on the continuous sheet of bag paper at periodic intervals in a predetermined longitudinal location such that the packets neither interfere with nor are removed by subsequent steps in the bag-making procedure.

9 Claims, 15 Drawing Figures

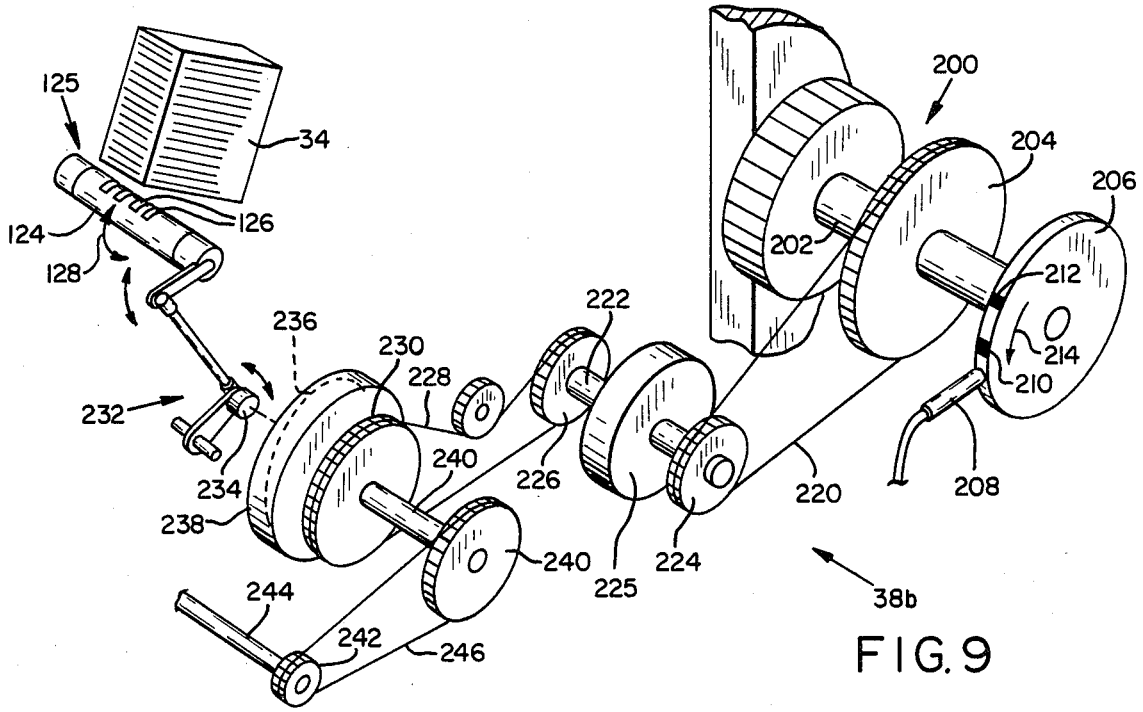
FIG. 9
FIG. 8
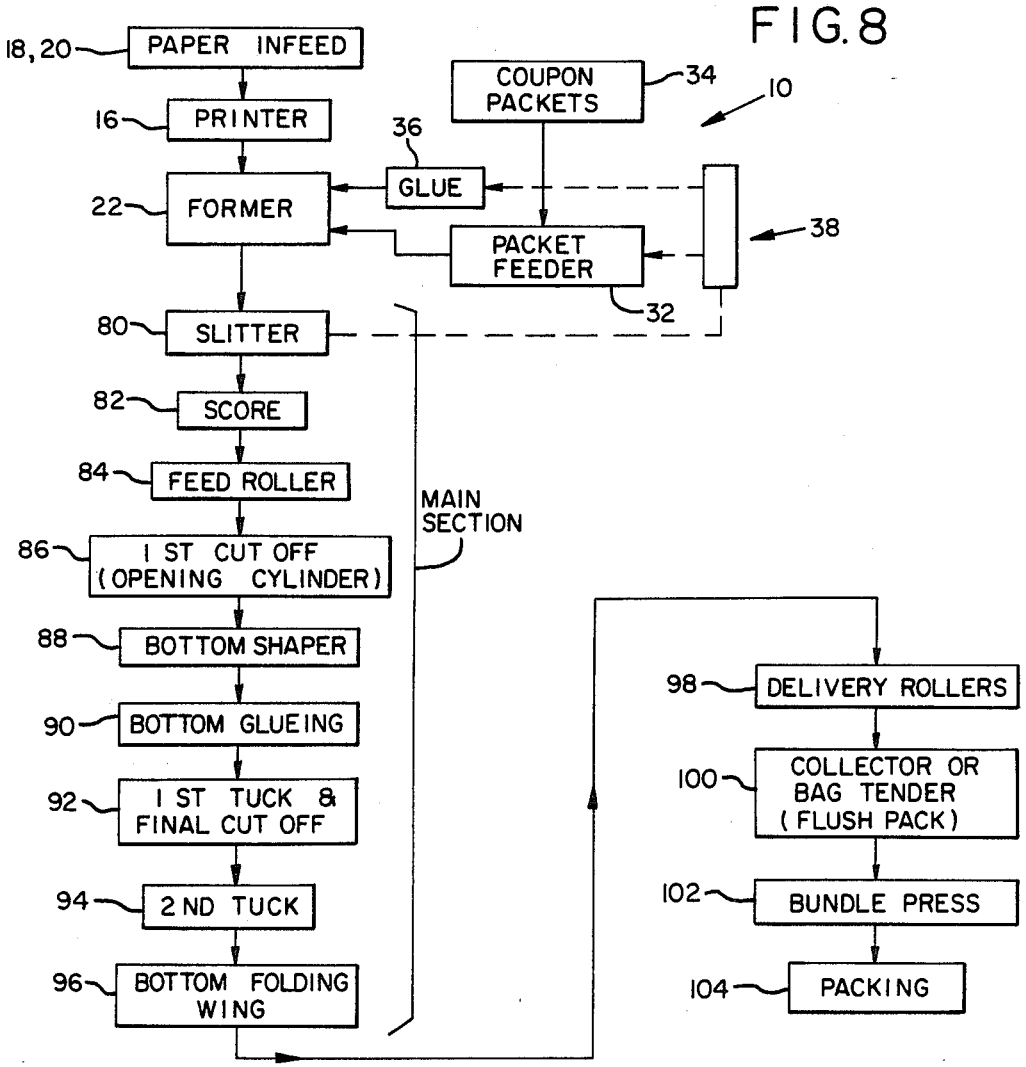

FIG.13
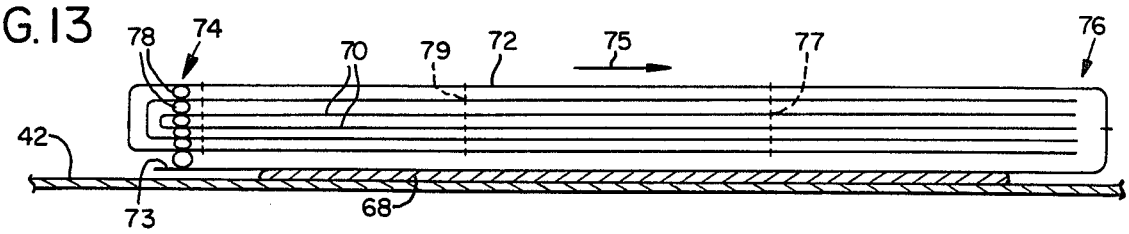
FIG.10
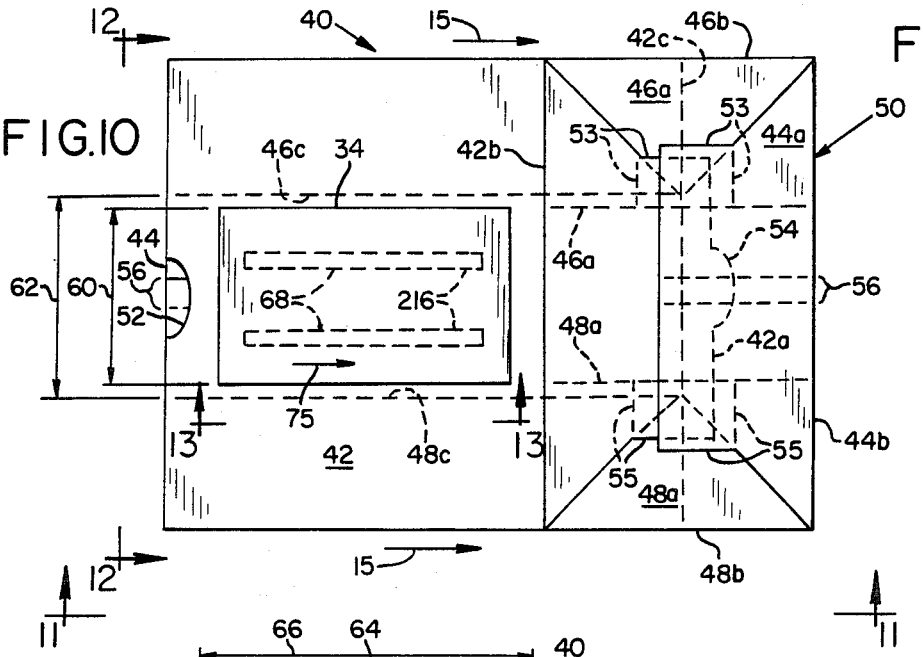
FIG.12
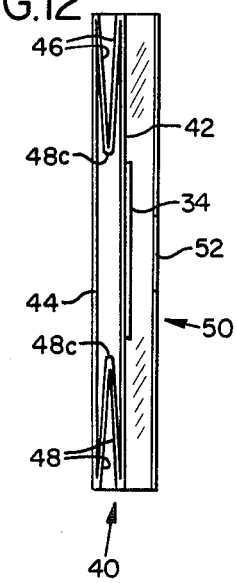
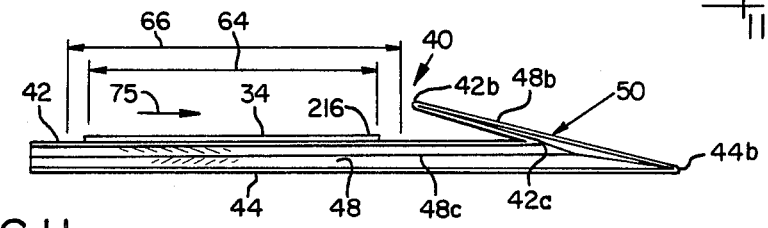
FIG.11
FIG.14
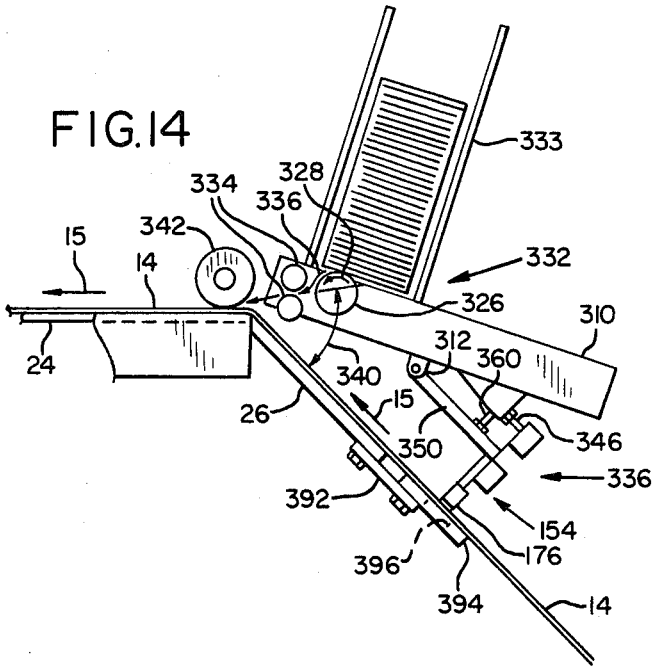

METHOD FOR APPLYING COUPON PACKETS TO PAPER BAGS

BACKGROUND OF THE INVENTION

This invention relates generally to application of information bearing labels, packets and the like to containers, and more particularly to applying detachable coupons to self-opening paper grocery bags.

It has long been recognized as desirable to be able to apply information-containing envelopes, packets and the like to containers such as bags. It has also been recognized as desirable to be able to open or remove the attached item. Several different ways of applying detachable coupons to bags have been tried. However, no practical approach has been developed for application of coupons to self-opening paper grocery bags, during manufacture, in such a way that the coupons can be readily detached by customers without damaging the bags.

U.S. Pat. No. 2,226,943 to Poppe discloses a paper bag in which a marginal portion of the bag material at the mouth of the bag is perforated for easy detachment. Such portion is imprinted as desired to provide either a coupon for customers or a customer's receipt. The form of bag used in Poppe is not a self-opening grocery bag, that is, a bag having four side panels and a bottom panel, but a pinch-bottom bag having two sides or panels connected along side and bottom edges. However, U.S. Pat. No. 3,804,323 to Bemel discloses a similarly imprinted, perforated coupon in a self-opening grocery bag. In both types of bags, the coupons can be readily imprinted during manufacture of the bags. Nevertheless, this arrangement has not proven widely acceptable in the marketplace. Customers are apparently unwilling to go to the trouble to tear off the coupons. Tearing off the coupons also damages the bags, limiting their reusability. Undamaged, the larger bags can be reused as garbage bags and the smaller bags as lunch bags.

U.S. Pat. No. 2,614,349 to Barnes discloses two-sided bags with a strip of imprinted paper, usable as a label or coupon, applied to the outside of the front panel of the bag during manufacture. U.S. Pat. No. 2,815,620 to Prodigo discloses a similar approach for applying detachable coupons to heat-sealed packages during manufacture. This approach avoids damaging the bags when the coupons are removed, but appears to be limited to essentially pinch-bottom bags. The shape of standard four-sided self-opening paper grocery bags, and the method and apparatus conventionally employed to make such bags, appear to preclude using the form and position of coupon strip and method of application taught by Barnes. The machinery for making self-opening bags is very complex and would likely tear off the coupon strip, with substantial risk of jamming, and possibly, damaging the machine.

The aforementioned patent to Bemel and U.S. Pat. Nos. D229,896 and D237-780 to Bemel disclose coupon packets affixed to the bottom panels of four-sided grocery bags. However, Bemel does not disclose how to apply such coupons to the bottom of bags and no method for doing so is known to exist. There is no known way of automating the application of the coupon packets to the bottoms of grocery bags. Prior attempts to devise such a method have failed. The coupon packets must therefore be applied to bags manually, an expensive, labor intensive effort. Also, applying the coupon packet to the bottom of the bag makes it very difficult to stack many of the bags when folded flat. The bags form very uneven stacks which are difficult to bind and to stack one atop another. These drawbacks virtually preclude application of the coupons during or immediately following manufacture of the bags since it makes them very difficult to ship. Moreover, the labor and expense required to manually apply the packets makes their application very impractical for either bag manufacturers or for grocers. Consequently, this manner of applying the coupons to grocery bags has not been widely accepted.

Other arrangements for applying or attaching packets or tags to bags require special construction of the bags. U.S. Pat. No. 1,541,167 to Mulvey discloses a sample-carrying packet applied to a bag. A transparent sheet overlies the sample and is attached to the bag by adhesive extending along margins of the transparent sheet. A cord is provided for tearing the transparent sheet to remove the sample. U.S. Pat. No. 2,083,860 to Offenbacher discloses a sandwich bag constructed to provide pouches in the base of the bag for carrying salt and pepper. U.S. Pat. No. 2,917,164 to Kehr, discloses a compartmented bag constructed to enclose a premium item, such as a baseball card, separately from the contents of the bag. In U.S. Pat. No. 3,348,759, Johnson discloses a specially designed paper bag in which the closure of the bag is arranged to receive the shopper's cash register receipt. None of these arrangements is desirable because each requires a special form of bag. It is preferable to be able to apply the coupons to standard four-sided self-opening paper grocery bags.

Various modes of applying tags and packets to boxes and cartons are also known. U.S. Pat. No. 3,183,614 to Loderhose discloses a cereal box having an extra flap which is perforated for easy removal and is imprinted as desired to provide a coupon or premium item. U.S. Pat. No. 4,103,820 to Mathison, et al. discloses a generally similar approach to providing a removable insert in one wall of a carton. U.S. Pat. No. 3,155,234 to Knoll, et al. discloses an arrangement for providing a packing slip packet on a package, the packing slip being contained within a transparent envelope which is perforated, or can be cut, to remove packing information. French Pat. No. 1,101,199 discloses an applique for providing descriptive information on a package. U.S. Pat. No. 4,202,450 to Howell, et al. discloses a method of incorporating labels between layers of transparent films making up a wall of a double-walled envelope or pouch. None of this group of patents suggests any better ways to provide detachable coupons on paper grocery bags.

Accordingly, a need remains for an inexpensive, convenient, and customer-acceptable way to apply coupons to self-opening grocery bags.

SUMMARY OF THE INVENTION

One object of the invention is to provide an improved mode of application of detachable coupons to grocery bags.

A second object is to provide a mode of attachment of coupons to four-sided self-opening grocery bags which can be readily automated.

A third object of the invention as aforementioned is to provide a method and apparatus for automating application of coupons to grocery bags.

A further object of the invention is to enable application of detachable coupons to self-opening grocery bags during manufacture of the bags.

Another object is to apply coupons to self-opening grocery bags in a way that does not interfere with stacking and shipping of the bags.

A first aspect of the invention is combination of a self-opening shopping bag and a coupon packet. The shopping bag has front and back panels, opposite side panels, and a bottom panel. Each side panel or gusset is folded inwardly along a crease to underlie the front panel and the bottom panel is folded over a lower margin of the front panel for folding the bag flat. Means defining a flat coupon packet containing coupons is affixed to the front panel of the bag.

The coupon packets are sized and positioned widthwise between the folded gussets and apart from the bottom of the bag so that, when the bag is folded flat, only the front and rear panels of the bag underlie the packet.

A self-opening paper-bag manufacturing system is provided which includes an apparatus for applying coupon packets to the paper bags during manufacture of the bags. The bag-making system generally includes infeeding means for longitudinally infeeding a continuous flat sheet or web of bag paper and bag-making means aligned with the infeed means to receive the sheet for making bags from successive longitudinal segments thereof. The bag-making means includes a forming means offset from the infeeding means and extending longitudinally between opposite edges of the sheet for continuously folding opposite margins of the flat sheet normal to the sheet to form the sheet into a tube. The machine also includes means rotationally driven for cutting and folding the successive paper segments into four-sided self-opening bags.

The coupon-applying apparatus is designed and positioned to apply coupons at the beginning of the bag-making procedure. It includes gluing means mounted adjacent the forming means for applying a strip of glue to a side of the continuous sheet opposite the forming means, the strip extending lengthwise of the sheet in a predetermined lateral position. A packet feeder means is mounted on the forming means for feeding coupon packets lengthwise of the paper flat onto the continuous sheet upon the strip of glue. A timing means is operably connected to the rotationally driven means for synchronizing therewith the operation of the gluing means and packet feeder means. It is timed to position each packet on the continuous sheet at periodic intervals in a predetermined longitudinal location such that the packets neither interfere with nor are removed by subsequent steps in the bag-making procedure.

The foregoing apparatus thus provides one way to carry out a method of applying coupon packets to grocery bags during manufacture of the bags. The method includes conveying a continuous sheet of bag paper in the longitudinal direction thereof; continuously turning longitudinal margins of the sheet downwardly to form the paper into a tube; and applying a strip of adhesive longitudinally to an upper side of the sheet at periodic intervals corresponding to the length of a segment defining a bag. A coupon packet is next fed from a stack of packets flat onto the upper side of the sheet over the adhesive to adhere the packet to the bag paper. Then, follow the steps of periodically cutting a portion of the sheet transversely to define a top of a first bag and a bottom of a second bag; folding portions of the longitudinal margins of each bag inward to form sides of the bag; and folding the bottom of each bag to close same, thereby completing the bag with the packet affixed to the front panel thereof.

Further features of the invention include centering the strip of adhesive and the packet approximately between the sides of the bag prior to applying the adhesive strip and spacing the adhesive strip and packet coupon apart from the bottom of each bag prior to applying the adhesive strip. The spacing step includes synchronizing the applying and infeed steps with the periodic cutting step.

The coupon should be sized to fit between the sides of the bag and between top and bottom of the bag, when the bag is folded flat, without overlapping the folded sides and bottom of the bag.

The foregoing and other objects, features and advantages of the invention will become more readily apparent from the following detailed description which proceeds with reference to the accompanying drawings.

Figure 4:
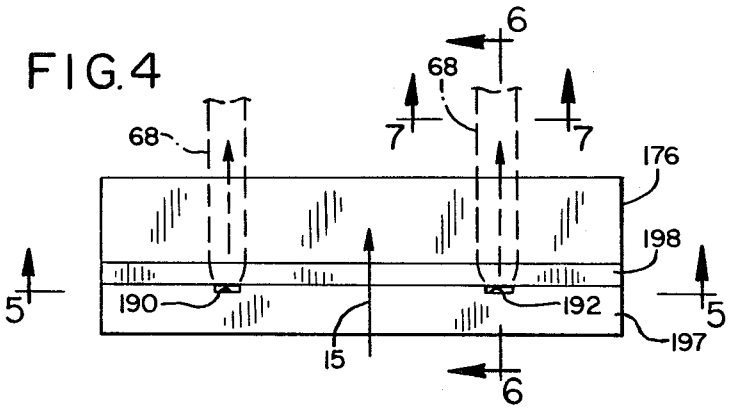
FIG. 4 is a bottom plan view of the gluing head taken at lines 4—4 in FIG. 3, an exemplary pattern of glue application at the paper being shown in phantom lines.

FIGS. *7a* and *7b* are enlarged cross-sectional views taken along line 7—7 in FIG. 4 showing the bag paper after passing under the gluing head, the glue smeared onto the paper in a thin layer in FIG. *7a* and, for comparison, an undesired manner of application of glue to the bag paper in FIG. *7b*.

Figure 1:
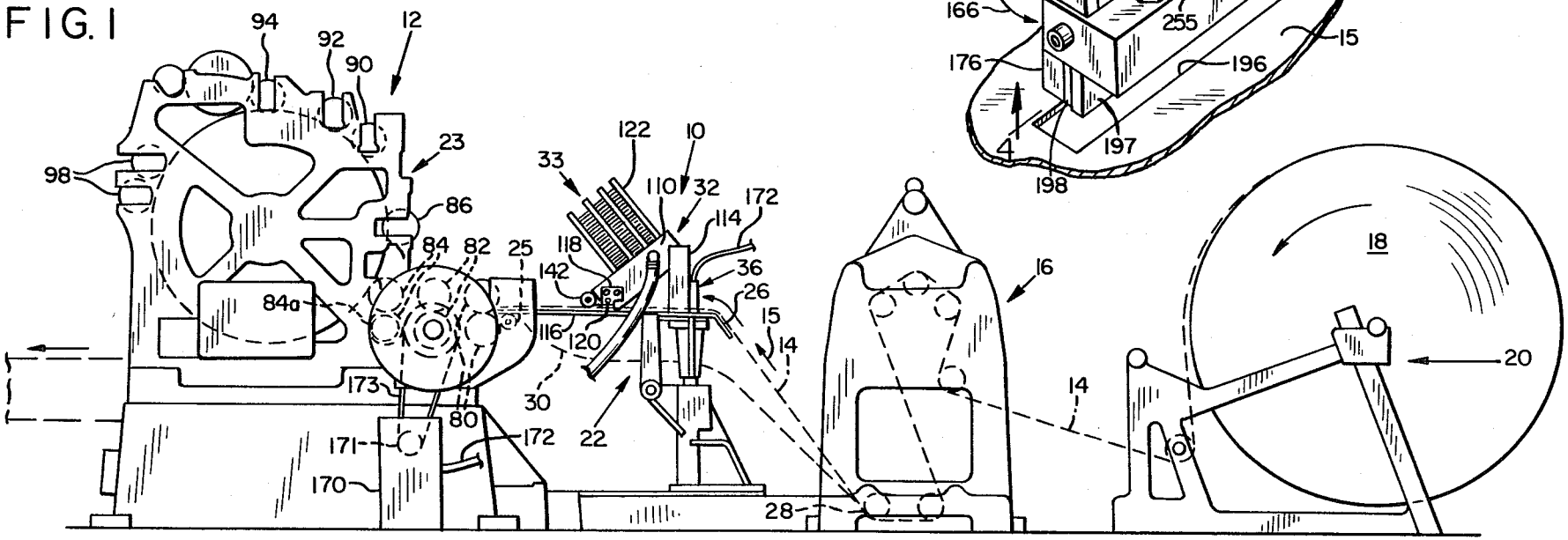
FIG. 1 is a side elevational view of a self-opening bag-making system including apparatus in accordance with the invention for applying coupon packets to the bags during their manufacture.

FIG. 8 is a flow chart of the steps performed by the apparatus of FIG. 1 in making a paper bag and applying coupon packets in accordance with the invention.

Figure 2:
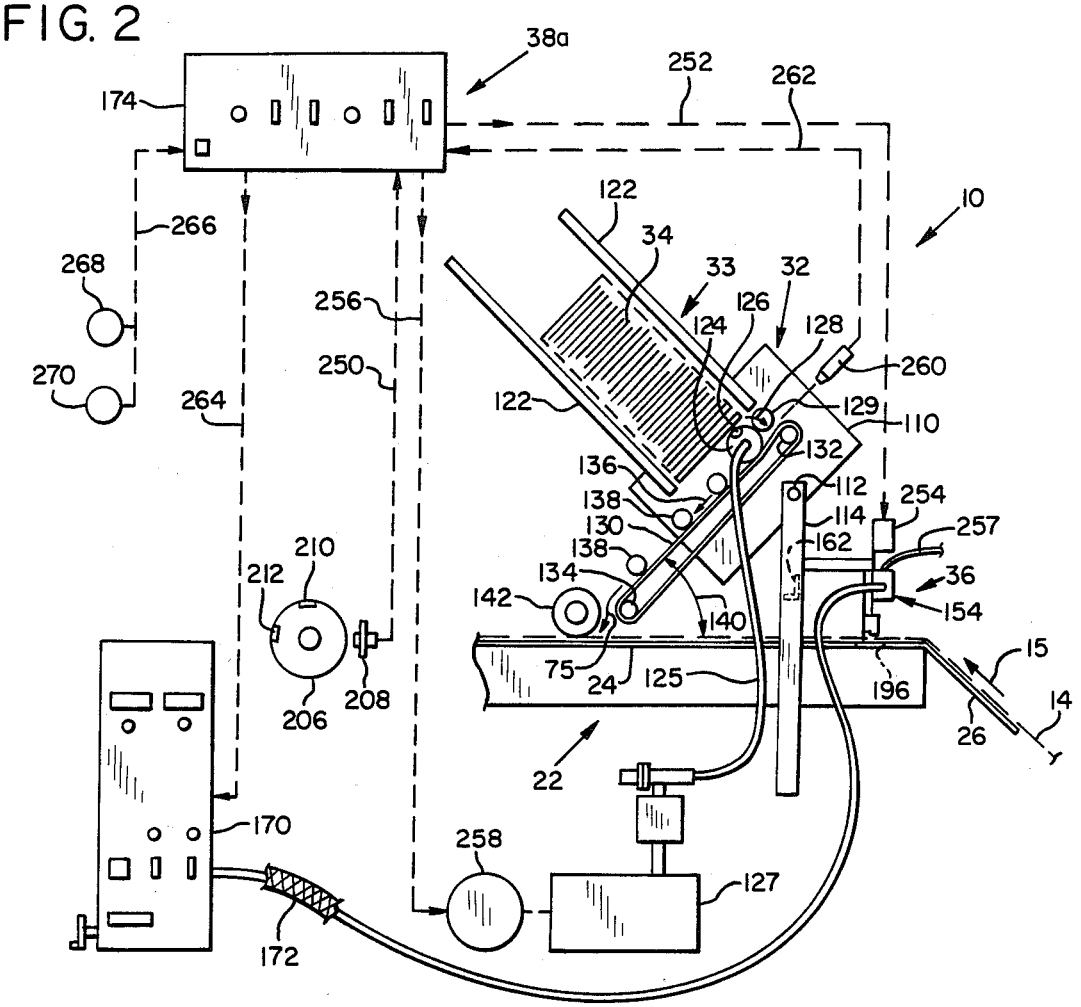
FIG. 2 is an enlarged view of a portion of the system of FIG. 1, showing further details of the coupon-applying apparatus and a diagram of its control system.

FIG. 9 is a fragmented perspective view of the coupon infeed apparatus and synchronization system used to drive the apparatus of FIG. 2.

FIG. 10 is a top plan view of a self-opening grocery bag having a coupon packet applied to the front panel thereof in accordance with the invention.

FIG. 11 is a side elevational view taken along lines 11—11 in FIG. 10.

FIG. 12 is a side elevational view taken along lines 12—12 in FIG. 10.

FIG. 13 is an enlarged side elevational view taken at lines 13—13 of FIG. 10 diagramming construction of the coupon packet.

FIG. 14 is a side elevational view of a second embodiment of coupon-applying apparatus in accordance with the invention.

DETAILED DESCRIPTION

Overall Arrangement

Referring to FIG. 1, coupon-applying apparatus 10 is integrated into a bag-making system which includes a bag-making apparatus 12. Bag paper is infed in a continuous sheet or web 14 in the direction of arrows 15 along an infeed path through an imprinter 16 from a paper roll 18 supported on a roll stand 20. The illustrated imprinter 16 and roll stand 20 are conventional devices made by POTDEVIN Machine Co. of Teterboro, N.J., and being well known to those in the bag-making industry, need not be described in detail. Bag-making apparatus 12 is a POTDEVIN Model 835 self-opening bag-making machine. Such machine has long been used in the bag-making industry and so its structure and operation are only described insofar as necessary to understand and use the present invention.

As paper 14 is infed to machine 12 from imprinter 16, it first passes over a former 22. The former functions to form the flat sheet of incoming paper into a tube as it enters the main section 23 of bag-making machine 12, generally as shown in the aforementioned U.S. Pat. No. 2,614,349 to Barnes. The former comprises a plate member which includes a horizontal downstream section 24 (see FIG. 2) and an upstream section 26. Section 24 is offset upwardly from outfeed rollers 28 of the imprinter and section 26 is inclined downwardly at an obtuse angle toward the outfeed rollers of the printer. Plate member 24, 26 is centered between the lengthwise edges of the sheet of paper 14. Thus, the former functions to continuously fold down opposite margins 30 of the incoming sheet of paper. The sheet then approaches main section 23 of machine 12 as a partially-formed tube. A pair of side plates (not shown) extend horizontally along plate section 24, one on each side, to fold margins 30 inwardly under plate 24 to form gussets or inwardly-folded side panels in the partially formed tube. A pair of rollers 25 underneath the former fold the margins of the sheet flat to form a lap seam and thereby complete the tube as it enters the main section. Thereupon, the tubular sheet is subjected to a series of operations to form it into bags, as further described hereinafter with reference to FIG. 8.

Referring to FIG. 2, the coupon-applying apparatus 10 is mounted on the former, above plate 24. It includes a packet feeder 32, which supports a bin 33 for coupon packets 34, and a glue applicator 36.

Utilization of the invention requires that operation of the packet feeder and gluing apparatus be coordinated with the rest of the bag-making system to position the coupon packets on the bags so that they neither interfere with nor are damaged by subsequent steps in the manufacture of the bags. For this purpose, a synchronization system is provided, which includes control system 38*a* (see FIG. 2) and a feeder drive assembly 38*b* shown in FIG. 9, as described in detail hereinafter. System 38 coordinates operation of the packet feeder and glue applicator with that of the main section 23 so as to position a coupon packet 34 on each bag 40 as next described.

Grocery Bag With Coupon Packet

Referring to FIGS. 10, 11, and 12, a grocery bag 40 has a single coupon packet 34 applied to a front panel 42 of the bag. Bag 40 is a standard self-opening grocery bag having, in addition to front panel 42, a back panel 44, opposite side panels or gussets 46, 48, and a bottom panel 50. A thumb notch 52 is cut in the center of the front panel at the mouth of each bag. A complementary arcuate flap 54 is formed inside the bottom panel 50 of each bag. Centered in the back panel 44, is a lap seam 56 which extends longitudinally from the mouth of the bag to the bottom panel.

In the bottom panel of the bag, lower end portions or tucks 46*a*, 48*a* of the side panels are folded toward the center of the bag. First and second tucks 42*a*, 44*a* formed by lower portions of the front and rear panels, respectively, are overlappingly folded toward one another along transverse creases 42*b*, 44*b* over tucks 46*a*, 48*a* to enclose the bottom of the bag. To enable folding tucks 42*a*, 44*a*, 46*a*, 48*a*, the bottom of the bag is slit along longitudinal lines 53, 55 and scored transversely along creases 42*b*, 44*b*. So that the bag can be folded flat, the side panels 46, 48 are folded inwardly along creases 46*c*, 48*c* to form tucks. Front panel 42 is scored transversely along crease 42*c* to fold bottom panel 50 flat against the front panel of the bag.

Coupon packet 34 is centered widthwise on the front panel of the bag. It is sized to a width 60 which is less than the spacing 62 between gussets 46*c*, 48*c* formed by the inwardly-folded side panels of the bag when the bag is folded flat. The coupon packet is also positioned lengthwise of the front panel between the mouth of the bag and bottom panel 50. It has a length such that the packet neither overlaps the mouth of the bag nor is overlapped by the bottom panel of the bag when the bag is folded flat. The coupon packet thus has a length 64 less than the length 66 of the front panel measured from crease 42*b* to thumb notch 52. If a thumb notch is not provided, the available space for packet 36 can extend to the mouth of the bag.

Referring to FIG. 13, coupon packet 34 comprises a plurality of rectangular sheets of paper, or coupons 70, enclosed within a stiff paper cover 72. Cover 72 is wrapped longitudinally around the coupons; folded flat at packet ends 74, 76; and an exposed end 73 of the cover is glued to an underlying layer of the cover at packet end 74. End 73 is directed oppositely of the direction 75 in which the coupon packet is fed during application to the bag. The coupons can be formed either by discrete elongated segments of paper folded in their middle at end 74 and free at the opposite end 76, or by a continuous length of paper folded at both ends 74, 76. In the latter case, the folded strip of coupons is preferably perforated at end 76. In either case, the coupons are adhered together and to cover 72 at end 74 by glue 78. The coupons and cover can be perforated if desired along dashed lines 77, 79.

The reasons for positioning the coupon packet as above described will become more readily apparent from the following description of the procedure for applying the packets during manufacture of the bags.

Method of Applying Coupons to Bags During Manufacture

In FIG. 8, the paper infeed system, imprinter, former and control blocks are identified by the same reference numerals used above in FIGS. 1 and 2. Also, the same reference numerals used below to identify succeeding steps in the bag-making process are used in FIG. 1 to identify the visible elements of machine 12 which perform such steps.

As the continuous sheet or web of paper passes over the former, hot melt or glue is first applied at step 36, and then a packet is infed onto the web by feeder 32. Next, the paper and affixed coupon enters the main section 23 of the bag-making machine. The web passes successively through a slitter and lip knife 80, a scorer 82 and feed rollers 84. Feed rollers 84 draw the bag paper through the machine and bottom roller 84*a* of machine 12 (FIG. 1) is relieved about 0.050" over a $4\frac{1}{2}$"

mid-portion of its length to let coupon 34 pass easily through the rollers. Slitter and lip knife 80 and scorer 82 are rotationally driven to slit and score the continuous sheet of paper at periodic intervals in a predetermined pattern corresponding to the length of each bag. Referring to FIG. 10, these operations cut a transverse thumb notch 52 in what will become the top edge of each bag, cut longitudinal slits 53, 55, and transversely score the paper along creases 42*b*, 42*c* and 44*b*, preparatory to forming the bottom of each bag. By means of synchronism assembly 38, shown in greater detail in FIGS. 2 and 9, operation of slitter 80 is used to control operation of the packet feeder 32 and the gluing assembly 36.

Next, returning to FIG. 8, the web passes through a first cut off and bottom-opening stage 86 at which an opening cylinder in machine 12, driven synchronously with the foregoing elements, partially cuts the continuous sheet transversely into segments. From the first cut off, the bag segments pass in turn through bottom shaper and bottom gluing stages 88, 90. In these stages, the bottom portions 46*a*, 48*a* of each segment are folded inwardly and glue is applied to start forming the bottom panel 50 of each successive bag 40. Next, in step 92, first tuck 42*a* is cut off, finally separating the bag segments, and folded over portions 46*a*, 48*a*. In step 94, second tuck 44*a* is formed and, at step 96, a pair of bottom folding wings operate to fold the second tuck in the opposite direction over the first tuck. Finally, each bag passes out of the main section through delivery rollers 98, which press the bottom of the bag flat against the front panel 42 of the bag, and is discharged into a collector or bag tender 100.

There, the bags are interleaved in opposite directions, that is, with the top of one bag positioned between the bottoms of two adjacent bags. Once a bundle containing a predetermined number of bags has been collected, the bundle is shifted to a bundle press 102 where it is compressed and bound. Thereafter, the bundles are transferred to a packing station 104, where they are wrapped for shipping.

Packet Feeder

Referring again to FIG. 2, packet feeder 32 is preferably a Halm Model JP6EX envelope feeder. The packet feeder has a housing 110, shown in place in FIG. 1 and removed in FIG. 2. The feeder is supported over former 24 by means of a horizontal shaft 112 pivotally received in upper ends of a pair of laterally spaced upright bracket members 114 mounted on side rails 116 (see FIG. 1) positioned on opposite sides of plate 24. A pair of brackets 118, laterally spaced on opposite sides of the feeder, support the front or downstream end of the feeder on the side rails. Set screws 120 in brackets 118 and resting on rails 116 provide means for vertically adjusting the position of the downstream end of the feeder. As mentioned above, the feeder includes a packet bin 33, defined by a plurality of parallel members 122 spaced to retain coupon packets 34 in a stack which is acutely angled from vertical.

At the bottom of bin 33 is rotating vacuum infeed mechanism or sucker assembly 126. Assembly 126 is connected for rotation by the drive mechanism 38*b* of FIG. 9, to rotate in the direction of arrow 128 to start feeding a packet from the bottom of the stack in bin 33 onto an infeed conveyor 130. A vacuum is provided to feed mechanism 126 through hose 125 from a vacuum pump 127. Operation of the vacuum pump and feed sucker assembly are described in further detail hereinafter with reference to FIG. 9.

As shown in FIG. 2, the infeed conveyor is a continuous belt conveyor supported by rollers 132, 134 and driven to feed each envelope between belt 130 and rollers 138 along an infeed path in the direction indicated by arrow 136. The infeed path is positioned at an acute angle 140, for example about 60°, from portion 24 of the former and the incoming back paper. Adjacent the outfeed end of the feeder, just downstream of roller 134, a pair of press rollers 142 are centered on the former to press the coupon packets against the upper surface of the bag paper 14. By the time the packet is fed onto web 14, the paper has traveled through the glue applicator.

Glue Applicator

Figure 3:
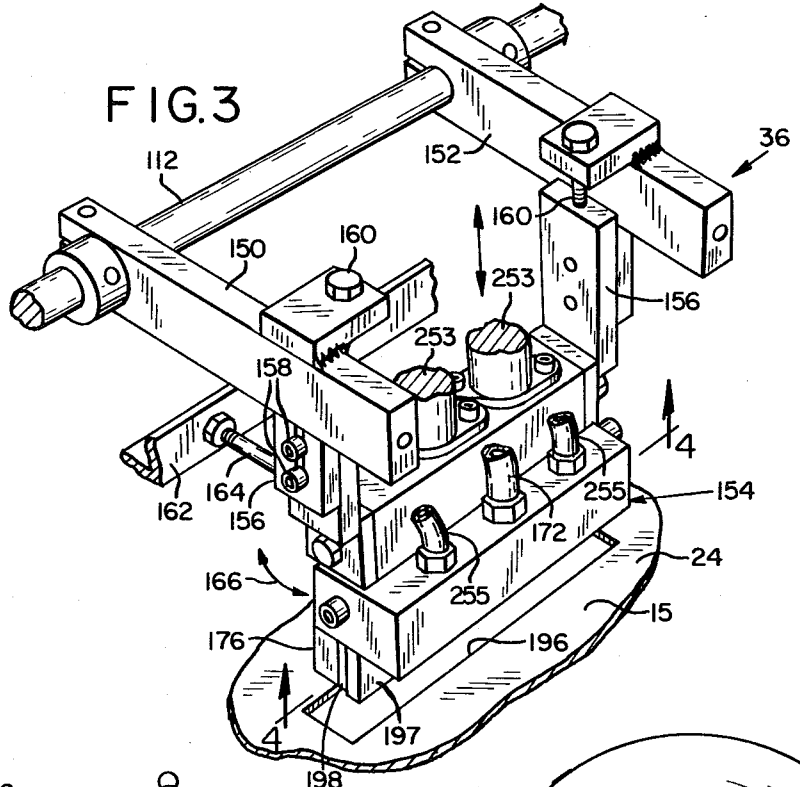
FIG. 3 is an enlarged top perspective view of the glue applicator of the apparatus of FIG. 2.

Referring to FIG. 3, the glue applicator is supported upstream of the packet feeder 32 by means of a pair of horizontal members 150, 152 pivotally received on shaft 112. A gluing or coating head assembly 154 is suspended between a pair of brackets 156 depended from members 150, 152, respectively. Brackets 156 are vertically adjustable by loosening Allen screws 158 and horizontally positionable along members 150, 152 upon loosening bolts 160, to reposition the gluing head. An angle member 162 extends horizontally between the upright members 114 at a position spaced between the former and shaft 112. A horizontal adjusting set screw 164 extends between the angle member and the gluing head to adjust the angle of the gluing head, as indicated by arrow 166.

Gluing head 154 is a double glue head, such as the Meltex Model EP45-1-105 coating head manufactured by Meltex Corporation of Peachtree City, Ga. for application of hot melt adhesive. Referring back to FIGS. 1 and 2, a Meltex GR 05-1, 230 volt, 1500 watt hot melt applicator 170 including gear pump 171 with a capacity of 5 kg/hr provide hot melt glue through insulated hose 172 to the gluing head 154. Solenoid-controlled pneumatic valves in the coating head actuate the emission of hot melt from head 154 under control of a Meltex Model ES46-2/1 electronic pattern control device 174, as further described hereinafter. The gluing head includes electrical heating elements (not shown) for maintaining the temperature of the hot melt in the gluing head, under thermostatic control of applicator 170.

Figure 5:
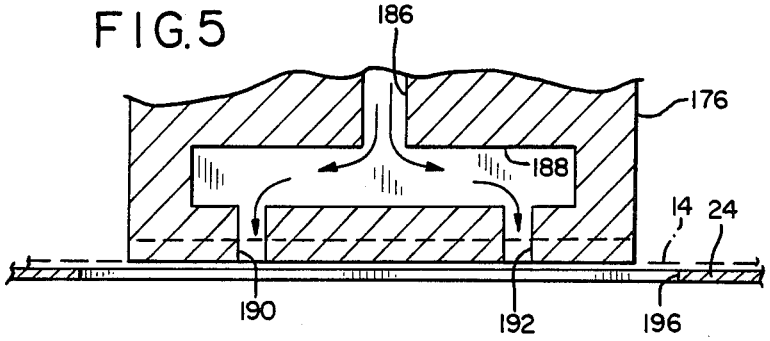
FIG. 5 is a transverse sectional view taken along lines 5—5 in FIG. 4, the bag paper shown in phantom lines.
Figure 6:
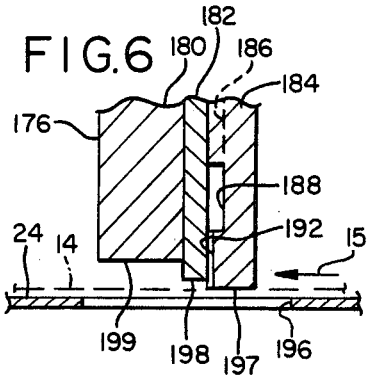
FIG. 6 is a cross-sectional view taken along lines 6—6 in FIG. 4, the bag paper shown in phantom lines.

Referring to FIGS. 4, 5 and 6, a special form of coating mouthpiece 176 is connected to the underside of the coating head 154. As shown in FIGS. 4 and 6, mouthpiece 176 is formed of three flat metal layers 180, 182, 184 sandwiched together. Plate 184 is inletted to provide a central, primary glue inlet 186, a laterally extending glue chamber 188 and a pair of glue outlets 190, 192 for emitting hot melt. The outlets are laterally spaced, for example, 4" (105 mm) apart.

Figure 7A:
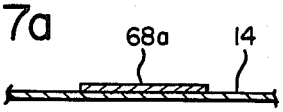
Figure 7B:
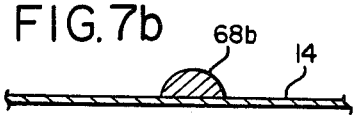

The gluing head is positioned at an elevation such that mouthpiece 176 presses downwardly against the paper to smear the glue emitted from opening 190, 192 into a broad flat layer 68*a*, as shown in FIG. 7*a*, rather than in a thicker narrower layer 68*b*, as shown in FIG. 7*b*. So that the mouthpiece can be pressed against the paper without tearing it, horizontal plate member 24 of the former is provided with an opening 196 positioned beneath the gluing head. The plates forming the mouthpiece are positioned so that plate 184, which is first contacted by the incoming paper 14, depresses the paper slightly into opening 196. The precise elevation of plate 184 relative to the upper surface of plate 24 is adjusted to suit the thickness of the particular paper that is being made into bags. For lightweight bag paper, the lower surface 197 of plate 184 would be at about the same level as the upper surface of plate 24 and thereby deflect the paper slightly downwardly into the opening. The lower surface 198 of plate 182 is spaced slightly above surface 197, for example, about 1/32", to allow glue emitted from opening 190, 192 to pass between surface 198 and the upper surface of paper 14. The upper surface of the paper passes very close to the trailing or downstream corner of surface 198 as the paper returns to the elevation of plate 24 and so such corner aids in spreading the glue on the paper, as shown in FIG. 4. The lower surface 199 of plate 180 is spaced well above surface 197, for example ½", to avoid contacting the paper.

The operation of the packet feeder and glue applicator to position the packets properly on the bags during manufacture is next described.

Synchronization System

Referring to FIGS. 2 and 9, the packet feeder and glue applicator are initially synchronized with the main section 23 of the bag-making machine 12 through a rotational drive mechanism 200 of the main section. Rotational drive 200 includes a rotating shaft 202 of slitter 80, which makes one complete revolution per bag. A drive sprocket 204 and a sensor disc 206 are mounted on shaft 202 outboard of the paper infeed path and slitter mechanism. A proximity switch or photodetector 208 is positioned adjacent the disc 206 to detect reflective start and stop markers 210, 212 on the periphery of the disc. These markers are spaced angularly apart about an angle 214 of rotation corresponding to the length of the glue strips 68 to be applied to each bag. Start marker 210 is angularly positioned in phase with approximately the lengthwise midpoint of each bag segment so as to cause the melting head to commence depositing glue strips 68 at points 216, shown in FIG. 10.

Synchronization sprocket 204 is connected through a first roller chain 220, a jack shaft 222 with sprockets 224, 226 on the ends thereof, and a second chain 228 and sprocket 230 to rotationally drive feeder 124 through linkage 232. The sprockets are sized to provide a one-to-one drive ratio from sprocket 204 to sprocket 230. Consequently, for each cycle of the slitter and lip knife, corresponding to the passage of one bag through machine 12, feeder 124 makes one revolution to infeed a single packet via conveyor 130 onto the incoming web of bag paper 14. Linkage 232 is a cam actuated crank linkage, including a cam follower 234 which is actuated by an internal camming surface 236 within the periphery of disc 238 mounted coaxially with sprocket 230 on shaft 240. Another sprocket 242 is mounted on shaft 240 for continuously driving a sprocket 242 on another shaft 244 through chain 246. Shaft 244 rotationally drives rollers 132, 134 of conveyor 130. Sprocket 242 is sized smaller than sprocket 240 to drive conveyor 130 through at least one full cycle during a single revolution of sprockets 204, 240. In case the packet feeder jams, a ratchet-type slip clutch 225 is incorporated into shaft 222. The slip clutch has internal alignment keyways or dogs which, when re-engaged, restore the original timing of system **38*b***.

Referring to FIG. 2, proximity switch 208 produces output signals on line 250 as elements 210, 214 are rotated past the switch. Line 250 carries the signals to electronic pattern control 174. The pattern control responds to the input signals by outputting various control signals to the packet feeder and glue applicator. A first electrical signal is output on line 252 to a control solenoid 254 in the glue applicator. Solenoid 254 controls a pair of pneumatic valves 253 (shown fragmentarily in FIG. 3) to which air is supplied from a 30–70 psi air source (not shown), to actuate via pipes 255 discharge of hot melt supplied via line 172, from coating head 154.

A second electrical signal is output on line 256 to control device 258 on vacuum device 127 to apply suction continuously to sucker assembly 124, through openings 126, to engage by suction the bottommost packet in bin 33. Through sprocket linkage **38*b*, the operation of feeder 124 is timed to coincide with rotation of internal camming disc 238 to a point where internal camming surface 236 engages cam follower 234 to start rotating 124 in the direction of arrow 128** to commence infeeding the packet.

As each packet passes between feeder 124 and roller 129, it is optically detected by a photo detector 260, which transmits a detection signal via line 262 back to controller 174. In this way, the controller verifies that packets continue to be fed from the packet feeder and thereby determines when packets are no longer being fed, either because the packet feeder is jammed or bin 33 is empty. Upon detecting that a packet has not been infed in response to transmission of a signal via line 256, transmission of signals via line 252, to the glue applicator, is suppressed so that glue does not continue to be applied to the incoming bag paper.

As mentioned above, the hot melt unit includes a gear pump for pumping hot melt out through hose 172. The gear pump is driven by sprockets and chain 173 from the scorer 82 at a 4:1 ratio to proportion the flow rate of hot melt to the speed of machine 12. That speed can be from zero to about 350 bags per minute while coupons are being applied. At all speeds, the rate at which hot melt is pumped out through hose 172 is proportioned to the rate of bag production. Controller 174 also has an output powerline 264 for providing electric power to unit 170. Power is input to the controller on line 266 through start and stop switches 268, 270.

The overall operation of the foregoing system is described after the following description of a second embodiment of the invention.

FIG. 14 Embodiment

Referring to FIG. 14, a different form of packet feeder 332 can be used in the bag-making system of FIG. 1. In this case, the preferred form of packet feeder is a Halm Model EX 3" feeder with a Model A-29534 outboard sucker assembly 326. This model is the same as that of FIG. 2 except that the sucker assembly 336 and bin 333 are positioned at the outfeed end of the feeder adjacent press roller 342. This arrangement feeds the packet along a generally straight path 336, rather than around a 180° turn and thereby minimizes feeder jamming.

With this arrangement, the packet feeder 332 and glue applicator 332 can be positioned adjacent the downwardly inclined portion 26 of the former. Bin 333, like bin 33 in FIG. 2, is positioned at an acute angle from the vertical, but is angled in the opposite direction toward the imprinter. Feeder 332 is positioned such that the outfeed end of the infeed path, feed rollers 334 and press down roller 342 are positioned adjacent the corner formed by portions 24, 26 of the former. As in the FIG. 2 embodiment, the infeed path is positioned at an acute angle 340 to the incoming sheet of paper.

The glue applicator is supported on a pair of arms 350 pivotally connected by tabs 312 to the underside of the body 310 of the packet feeder. Arms 350 extend generally parallel to inclined former portion 26 toward the incoming paper. Vertical and horizontal adjustment screws 360, 346 are provided to adjust the elevation and angle of gluing head 154 relative to the incoming paper 14. Mounted on the upstream end of former portion 26 by means of a connector plate 392, is a support plate 394 for supporting paper 14 beneath the gluing head. An opening 396 is provided in plate 394 so that mouthpiece 176 can be positioned at an elevation to depress the paper slightly into the opening, in the manner previously described with reference to FIGS. 3–7.

The synchronization system and vacuum, air and hot melt supply systems used in connection with the embodiment of FIG. 14 are substantially the same as those described above with reference to FIGS. 2 and 9. Likewise, the operation of the FIG. 14 embodiment is like that of the FIG. 2 embodiment.

Operation

Referring to FIG. 1, paper 14 is threaded from roll 18 through imprinter 16 over the former 24, 26, beneath first glue applicator 36, over opening 196, beneath the outfeed end of packet feeder 32 and press down rollers 142 and then into bag-making machine 12. For convenience in threading the paper, both the gluing head and packet feeder can be pivoted upwardly away from the former about shaft 112. Once the paper has been threaded into the main section of the bag-making machine, the glue applicator and packet feeder are returned to their operating positions, as shown in FIGS. 1–3.

The bin of the packet feeder is then filled with packets 34 and power is provided to control unit 174. Through the control unit, the motor 258 driving vacuum pump 127 and melt applicator 170 are turned on and given sufficient time to reach operating conditions. Power is also applied to the heater elements in the gluing head and to the solenoids which actuate the gluing head. Air pressure is also turned on to power the gluing head actuators.

The bag-making machine 12 and imprinter 16 can now be turned on and the packet feeder and glue applicator are enabled through control unit 174. As paper 14 travels along the former, the slitter and lip knife 80 and succeeding elements of the main section of the bag machine operate to form segments of the continuous sheet into bags. Each cycle of the slitter shaft 202 causes rotation of drive train 200 through a single cycle to rotate the sucker assembly 124 and thereby commence feeding of a packet from bin 33. Shaft 244 continuously rotates the drive conveyor 130 to feed the packet downwardly at acute angle 140 toward the upper surface of the bag paper, supported on portion 24 of the former.

As shaft 202 rotates, synchronization system **38*b* commences rotation of sucker assembly 124, to which the vacuum device 127 continuously applies a vacuum. Air is drawn into the sucker assembly through openings 126 to draw the adjacent end of the bottommost packet in bin 33 down against the sucker assembly and adhere the packet to the surface thereof so as to carry the packet around to conveyor 130 upon actuation of camming linkage 232. Meanwhile, elements 210, 212 on disc 206 are successively detected to transmit start and stop signals to controller 174. Photo detector 260 detects the passage of a packet between the sucker assembly and roller 129 and transmits an enabling signal on line 262 to controller 174. Thereupon, the controller transmits an electrical signal on line 252 to solenoids 254 to actuate emission of glue through the coating head 154 to form strips 68 commencing at approximately the midpoint of each segment of bag paper defining a bag. Unit 174 can be adjusted to vary the pattern of strips 68 lengthwise, for example, to form a series of spaced spots of glue rather than a continuous line. Timing adjustments can be made by moving elements 210, 212 on disc 206 to adjust the timing of the signals on line 252 to position the strips of glue and the packet on the front panel of each bag as shown in FIGS. 10 and 11**.

As the bag paper proceeds through the main section of bag-making machine 12, it passes through the various steps described above with reference to FIG. 8. Proper centering of the coupon packet has proven to be critical to successful performance of the succeeding steps in making the grocery bags without detaching the coupon packets. In particular, misplacing the packets lengthwise of the bag would cause jamming at the first cut-off 86, interfering with operation of the opening cylinder. If the coupon packet is too close to the bottom panel, jamming would occur upon the operation of the bottom folding wings to close the bottom panel of the bag. Misplacing the coupon packet on the bag might also cause jamming at or interfere with the slitter and lip knife step 80, the scoring step 82, the bottom gluing step 90 and the first tuck and final cut-off step 92. Additionally, miscentering the coupon packet sufficiently to overlap one of the inwardly folded side panels 46, 48 of the bag will create an excessive bag thickness in that portion of the bag and interfere with stacking and packing the bags in bundles. Centering the coupon packet on the front panel of the bag, and positioning it lengthwise of the bag so that it neither overlaps the thumb notch nor underlies the bottom panel of the bag when folded flat, avoids these problems.

Having illustrated and described the principles of our invention in preferred and alternate embodiments thereof, it should be apparent to those skilled in the art that the invention may be modified in arrangement and detail without departing from such principles. Accordingly, we claim all modifications within the spirit and scope of the following claims.

We claim:

1. A method of applying a coupon packet to the outer face of the front panel of a four-sided self-opening paper grocery bag, comprising:

conveying a continuous web of bag paper in the longitudinal direction thereof;

bending the web in the longitudinal direction about an obtuse angle and continuously turning longitudinal margins of the web downwardly to form the web into a tube;

applying a strip of adhesive longitudinally to the upper side of the web between said margins at periodic intervals corresponding to the length of a segment defining a bag, the strip commencing at about the lengthwise midpoint of the segment;

after bending the web about the obtuse angle, feeding a coupon packet from a stack of packets flat onto the upper side of the web over the strip of adhesive to adhere the packet to the upper side of the web of bag paper;

periodically cutting a portion of the web transversely to define a top of a first bag and a bottom of a second bag;

folding portions of the longitudinal margins of each bag inwardly to form inwardly-folded side panels of the bag; and folding the bottom of each bag to close same.

2. A method according to claim 1 including centering the strip of adhesive and the packet approximately between the sides of the bag.

3. A method according to claim 2 including spacing the adhesive strip and the coupon packet apart from the bottom of each bag.

4. A method according to claim 3 in which the spacing step includes synchronizing the adhesive strip applying step and the coupon packet feeding step with the periodic transverse cutting step.

5. A method according to claim 3 including sizing the coupon packet to fit between the side panels of the bag when inwardly folded and between the top and the bottom of the bag when the bag is folded flat, whereby the coupon packet does not overlap the inwardly folded side panels and the bottom of the bag when the bag is folded flat.

6. A method according to claim 5 including stacking the bags in a staggered stack wherein alternating bags are turned in opposite directions and positioned so that the bottoms of the alternating bags are longitudinally spaced apart about the coupons and thereafter tying the stack.

7. A method according to claim 1 in which the coupon packet feeding step includes stacking a plurality of packets each having a thin, rigid leading edge and mechanically infeeding packets one at a time from the bottom of the stack.

8. A method according to claim 1 including wrapping a strip of cover paper lengthwise around a plurality of coupons, connecting opposite ends of the cover paper together to form a continuous loop, connecting the coupons at one end to an inner side of the loop of cover paper, and folding the loop flat at the connected end of the coupons and at an opposite end of the coupons, to form a coupon packet.

9. A method according to claim 8 in which the wrapping of said strip of cover paper includes wrapping the strip so that an exposed end of the strip is directed outwardly from the one end of the packet to which the coupons are connected, and the feeding of the packets includes feeding each packet lengthwise toward the other end of the packet.

* * * * *